United States Patent [19]

Davis

[11] Patent Number: 4,681,509

[45] Date of Patent: Jul. 21, 1987

[54] VARIABLE INLET FAN ASSEMBLY

[75] Inventor: Robert J. Davis, Birmingham, Mich.

[73] Assignee: American Davidson, Inc., Hyde Park, Mass.

[21] Appl. No.: 859,199

[22] Filed: Apr. 28, 1986

Related U.S. Application Data

[63] Continuation of Ser. No. 633,571, Jul. 23, 1984, abandoned.

[51] Int. Cl.[4] ..... F04D 29/46; F04D 29/68

[52] U.S. Cl. ..... 415/161; 415/DIG. 1

[58] Field of Search ..... 415/159, 160, 161, 162, 415/163, 164, 150, DIG. 1

[56] References Cited

U.S. PATENT DOCUMENTS

| | | | |
|---|---|---|---|
| 2,650,752 | 9/1953 | Hoadley | 415/DIG. 1 |
| 2,797,044 | 6/1957 | Lovesey | 415/161 |
| 3,039,736 | 6/1962 | Pon | 415/DIG. 1 X |
| 3,583,827 | 6/1971 | Wood | 415/159 |
| 4,013,377 | 3/1977 | Amos | 415/161 |
| 4,208,167 | 6/1980 | Yasugahira et al. | 415/DIG. 1 X |
| 4,239,450 | 12/1980 | Geitner et al. | 415/160 |
| 4,299,535 | 11/1981 | Brockman et al. | 415/160 |
| 4,378,960 | 4/1983 | Lenz | 415/164 X |

*Primary Examiner*—Robert E. Garrett
*Assistant Examiner*—Joseph M. Pitko
*Attorney, Agent, or Firm*—Irvin L. Groh

[57] ABSTRACT

A variable inlet vane assembly for use with force draft and induction draft systems having a fan. The vane assembly comprises a mounting base and a hub supported in spaced relationship by a plurality of supports. The inlet vanes are pivotally supported between the base and the hub and are engaged by an actuating ring. An annular sliding bearing is interposed between the actuating ring and the hub. A plurality of stationary dorsal vanes are mounted downstream and in close relationship to the main vanes to control violent back eddies of air which occur at low vane closures.

23 Claims, 12 Drawing Figures

VARIABLE INLET FAN ASSEMBLY

This is a continuation of application Ser. No. 633,571, filed on July 23, 1984, now abandoned.

This invention relates to an improved variable inlet vane assembly for use with either forced draft or induction draft air flow systems to preswirl incoming ambient atmospheric air so that the work load on the fan rotor is substantially reduced, thereby greatly increasing the efficiency of the system in terms of fuel economy.

This invention further relates to a variable inlet vane assembly having a substantially reduced axial length between the variable inlet vane and the bearing attendant to such structures whereby it is possible to construct a variable inlet vane assembly having larger variable inlet vanes for a given structure to produce greater efficiency for preswirling incoming air.

This invention further relates to a variable inlet vane assembly wherein conventional roller bearings between an actuating means and the variable inlet vane is replaced with a sliding bearing means thereby effectively eliminating the need for routine lubrication maintenance.

This invention further relates to a variable inlet vane assembly wherein the linkages between the actuator and the variable inlet vane blades are outside of the flow of incoming atmospheric air, thereby eliminating the danger of corrosion and contamination by airborne particulate matter.

This invention further relates to a variable inlet vane assembly which includes a venturi interposed between the variable inlet vane assembly and the rotor of the system whereby the venturi preserves the preswirl imparted to the incoming air by the variable inlet vane assembly thereby passing the preswirl onto the fan of the system, so as to reduce the work load necessary by the fan in order to move the given volume of air.

Variable inlet vane assemblies are old and well known in the art. However, the variable inlet vane assemblies of the prior art included placing the linkages which transmitted the motion from the actuator means to the variable inlet blades in the path of the incoming air flow where they could be contaminated by airborne particulate matter. Moreover, by placing the linkages in the path of the incoming air flow, they were subject to frequent maintenance problems because of the aforementioned contamination. Further, the linkages were placed so as to preclude easy maintenance thereof. Rather, the linkages of the prior art were placed in inaccessible areas so that disassembly of the entire system was necessary in order to service the linkages. This proved to be costly and time consuming.

Further, the prior art contemplated the use of conventional roller bearings between the actuating means and the variable inlet vane assembly itself. Thus, the variable inlet vane assemblies had to be made larger in order to accommodate the proper size vane blades. This shortcoming is overcome in the present invention wherein the conventional roller bearings are replaced with a flat sliding bearing means so that for a given size variable inlet vane assembly, the present invention offers the advantage of allowing a larger size vane blade while at the same time decreasing the axial length between vane blade and bearing.

The present invention further presents a variable inlet vane assembly having a variable inlet vane and a stationary dorsal vane to control back eddies of air pressure which occur at low vane closures. In this manner, the air is preswirled with minimal loss within the system thereby greatly contributing the efficiency of the system by decreasing the amount of work the fan must do to move a given volume of air. Moreover, the present invention utilizes a venturi to preserve the preswirl imparted to the air, thereby contributing to the improved efficiency of the present invention. Thus, the present invention differs from the prior art.

The present invention is a variable inlet vane assembly for use with forced draft or induction draft air flow systems which gives greater control over preswirling of ambient atmospheric air into the fan to reduce the amount of work needed to be done by the fan to move a given volume of air into the desired directions. The preswirling parted to the ambient air by the variable inlet vane assembly varies the velocity profile of incoming air onto the fan wheel by giving the air a preswirl to contact with the fan thereby making it easier to move a given volume of air in any desired direction with less BHP.

The present invention presents the advantages of placing the linkages which actuate the variable inlet vane blades outside the path of incoming air thereby eliminating contamination of the linkages by airborne particulate matter. Further, the present invention replaces conventional roller bearings around the variable inlet vane assembly with a self lubricated ring bearing such as graphite impregnated nylon plastic or any other suitable material which eliminates the need for lubricating maintenance on the bearing as well as shortens the axial length of the vane blade to linkage, thereby allowing for a larger vane blade in a given sized variable inlet vane assembly housing.

A dorsal vane is added to the variable inlet vane assembly to control violent back eddies of air which occur at low vane closures. This preserves the preswirl advantage of the variable inlet vane assembly at all ranges of vane closure.

This variable inlet vane assembly is useful in both induced draft systems and forced draft systems wherein it is desired to move ambient atmospheric air with a fan blade at the minimum British Horsepower (BHP) expenditure possible. Finally, the variable inlet vane assembly of the present invention is mounted upon a venturi which greatly reduces the losses in the preswirl air as it passes from the variable inlet vane assembly into the fan itself by increasing the velocity of the air and presenting a smooth surface for the air to contact thereby greatly reducing losses according to friction and distortion by nonaerodynamic obstacles.

By use of the variable inlet vane assembly of the present invention, incoming atmospheric air is preswirled as the vanes are closed, with minimal loss in the system, thereby greatly contributing to the overall efficiency of the system by decreasing the amount of work the fan must do in order to move a given volume of air in any desired direction. When the vanes are opened in the opposite direction, the pressure of the incoming air as well as its volume is increased thereby increasing the work done by a given sized fan. Thus, the present invention further provides the advantage of a greater workload for a given size fan.

Figure 1:
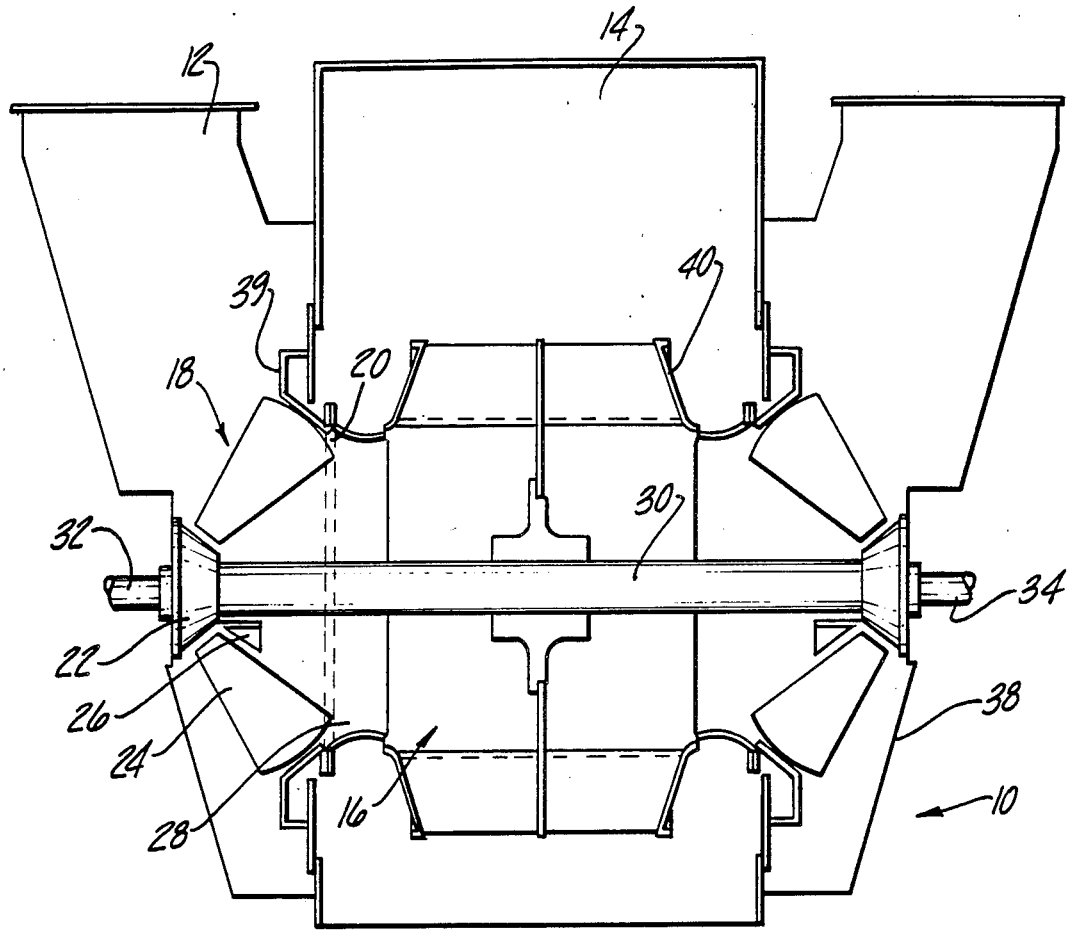
FIG. 1 is a diagrammatic view of an induction draft system showing the orientation of the variable inlet vane assembly of the present invention.

FIG. 1 depicts a diagrammatic view of an induction draft system generally designated at 10 having inlet vents 12 and outlet vents 14. A fan impeller 16 is disposed within the center of the system and is used to move atmospheric air in a desired direction in a conventional manner.

The inlet vane assembly which is the subject of the present invention, is generally designated at 18 and comprises a base 20 and a hub 22 wherein main vane blades 24 are pivotally suspended. Dorsal vanes 26 are provided in close proximity to the main vane blades in order to control violent back eddies of air which occur at low vane closures. The assembly is mounted at base 20 to venturi 28 wherein air moving through the vane assembly is preswirled and moves through the venturi without any appreciable loss of preswirl, as well as increased velocity, into the fan rotor 16. The action of the preswirl reduces the work load on the fan impeller thereby allowing the fan impeller to move a given volume of air at a lower BHP output.

Both the fan and the hub are mounted upon main shaft 30. The main shaft 30 is equipped with a free riding shaft 32 and a drive shaft 34 at opposite ends of the main shaft and concentric thereto. Free riding shaft 32 is disposed within a bearing, not depicted, so as to free ride during rotation of the main shaft. Main shaft 30 is rotated by the drive shaft which is connected to a driving means, not depicted, in the conventional manner. As the drive shaft is rotated, it rotates the main shaft 30 thus turning the impeller. The impeller draws air in through inlet vents 12 where it encounters the variable inlet vane assembly of the present invention. The air, when passing through the vanes, is preswirled in the direction of rotation of the impeller 16 so that upon encountering the impeller, the work load on the fan for moving the air is substantially less than would otherwise be expected if no preswirling had occurred. The air passes through venturi 28 where its velocity is increased to air in reducing the work load upon the fan. The venturi is further provided so that the air passes through an air-streamed passage so that there are no losses in the preswirled air. The fan then moves the air through venturi 40 into the outlet ducts 14. The entire draft system is enclosed within housing 38 as is conventional in the art.

Figure 2:
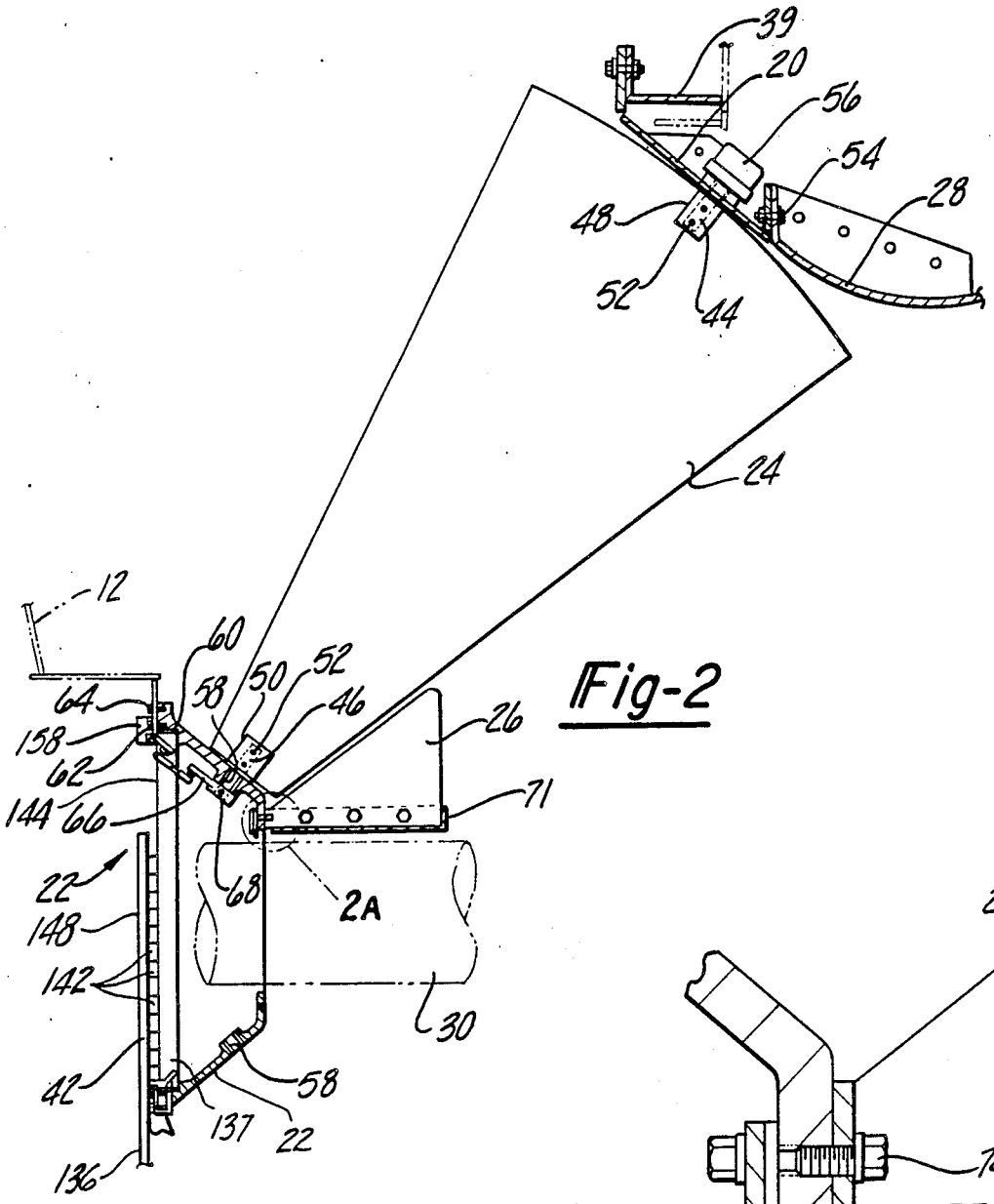
FIG. 2 is a fragmentary detailed view of an inlet vane and actuating means therefor according to the present invention.

FIG. 2 is a detailed view of one embodiment of the variable inlet vane of the present invention. Specifically, main vane blade 24 is shown pivotally mounted between hub 22 and a mounting base in the form of a ring 20 in the manner to be hereinafter described. Dorsal vane 26 is provided in close proximity to the main vane blades and is provided so as to control violent back eddies of air which occur at low vane closures. This further aids in reducing any losses to preswirled air as it passes through the vane blades into the draft system.

As shown in the Figure, base ring 20 is mounted at one end to preswirled venturi 28 and at its other end in a manner not depicted to inlet vane assembly frame 39. Mounting base 20 may further be described as frustroconical and constructed so that it tapers into the venturi. The main vane blade is pivotally mounted at one end to the base ring 20 through various apertures, and pivotally mounted at its other end to hub 22.

Main vane blades 24 are provided with an upper stub shaft 44 at one end and a lower stub shaft 46 at their upper ends. The stub shafts are retained within upper and lower bearing retainer assemblies 48 and 50, respectively, and held in place to the variable inlet vane blade by shaft retaining means 52. Upper stub shaft 44 is provided with a stub shaft end cap 56 to protect the stub shaft and bearings from contamination and wear. Lower stub shafts 46 pass through apertures 58 in the hub and are connected to linkage means 66 by linkage attachment means 68 depicted as pins. The linkage means are attached to an actuating means 42 wherein the movement of the actuating means actuates the linkages and moves the variable inlet vanes in a manner to be hereinafter described.

Figure 2A:
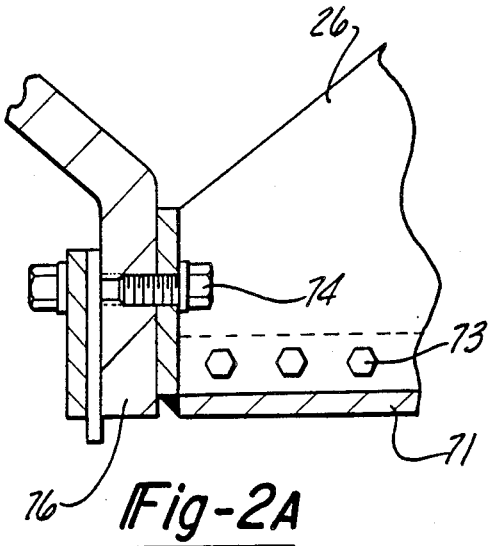
FIG. 2A is a fragmentary enlarged view of a dorsal vane and support therefor shown in FIG. 2.

FIG. 2A depicts a detail of the dorsal vane 26 of FIG. 2 showing its attachment to the hub. Specifically, dorsal vane 26 is carried upon carrier assembly 71 and affixed thereto by attachment means 73. The entire assembly is then attached to the flange 76 of the hub 22 by attachment means 74 depicted as a bolt. In this manner, it is held in rigid relationship to the variable inlet vane to control the violent back eddies which occur at low vane closures.

Figure 2B:
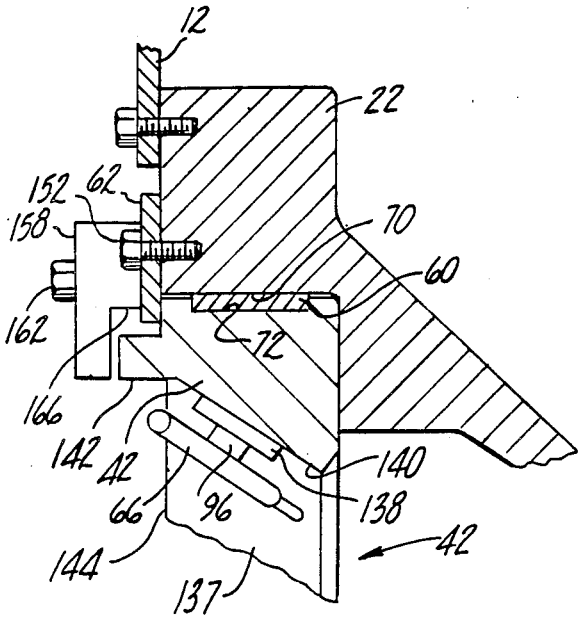
FIG. 2B is a fragmentary enlarged view of a vane actuating means and the bearing support therefore shown in FIG. 2.
Figure 2C:
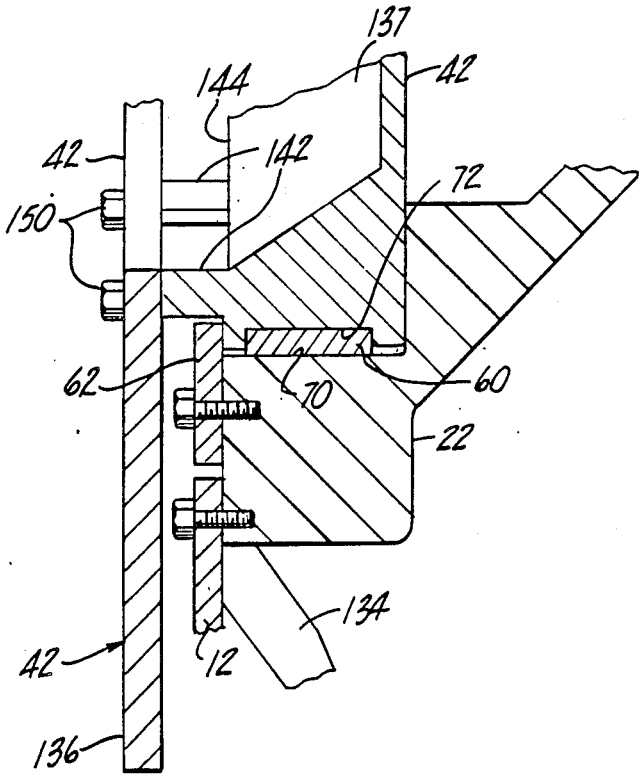
FIG. 2C is a fragmentary enlarged view of another portion of the vane actuating means and the bearing structure therefor shown in FIG. 2.

FIG. 2B is a detailed cross-sectional view of bearing means 60 showing its relationship with the actuating means 42 and the hub 22. Specifically, FIG. 2B depicts the sliding bearing means 60 interposed between the actuating means 42 which provides the outer race 72 for the bearing means 60, and the hub itself which provides the supporting base 70 for the bearing means, as depicted. A sliding bearing retaining means 62 is provided to retain the bearing within its race and interposed between the actuating means and the hub. The sliding bearing means is a self lubricating bearing made of any suitable material, such as a graphite impregnated plastic which requires little, if any, maintenance and has a long life in use. The bearing provides superior bearing properties as compared with a conventional roller bearing so that it is possible when using the sliding bearing means of the present invention to operate the actuating lever with a minimal force and if necessary, even manually. The bearing, because it has no grease applied to it, is resistant to picking up dirt which causes undue wear. Also, the use of this sliding bearing means shortens the axial length between the vanes and the control linkage. This provides the advantage of greater control over preswirling of the air and allows for larger vane blades within any given housing.

Figure 4:
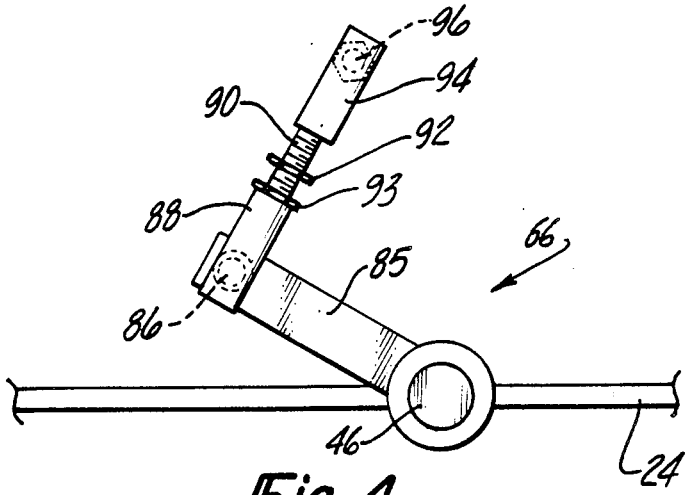
FIG. 4 is an end view of one inlet vane depicting its connection with a linkage means.
Figure 3:
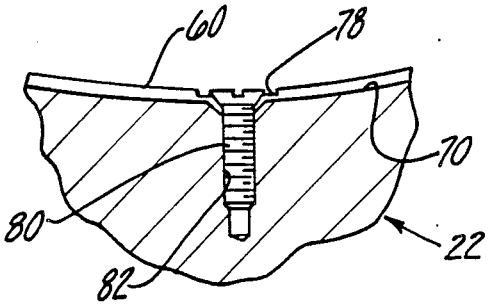
FIG. 3 is a fragmentary enlarged view of a bearing structure for the vane actuating means shown in FIGS. 2, 2B and 2C.

FIG. 3 is a detail view of the sliding bearing means of the present invention showing its attachment to inner race 70. Specifically, the sliding bearing means is provided with various aperture 78 therein which accommodate retaining means 80 depicted as flat-headed screws. It is important when affixing the bearing means to the base 70, that the retaining means not interfere with the action of the bearing. To this end, it is also conceivable to use an adhesive glue or some other attachment means to secure the bearing in place. The only requirement in securing the bearing in place is that the securing means be removable and not interfere with the action of the bearing so that while the bearing is in use, the actuator means will move freely, and if it should become necessary to service the bearing or replace it, it may be easily removed and replaced, thereby resulting in a savings in maintenance over the prior art. As depicted in FIG. 3, the retaining means 80 is disposed within recess 82 of the base 70 which is in the hub 22. FIG. 4 depicts a top view of one embodiment of the linkage contemplated for use in the present invention. Specifically, linkage 84 is comprised of linkage arm 85 which is pivotally attached to sleeve 88 at one end by pivot pin 86 and secured to lower stub shaft 46 of variable inlet vane blade 24. The sleeve 88 accommodates adjustable link 90 to adjust the length of the linkage to the desired configuration. Specifically, adjustable linkage 90 is a threaded member which screws into the sleeve 88 at its one end and sleeve 94 at its other end. Adjustment retaining nuts 92, 93 are provided so that when the desired adjustment has been made, the adjustment retaining nuts may be secured in place thereby preventing any further adjusting of the linkage during rotation of the fan. Sleeve 94 is pivotally secured and pivotally attached at its other end by pivot 96 to the actuating means so that by activating the actuating means, the linkage is actuated and the vane blade moves. This will be explained in greater detail in reference to FIG. 8.

Figure 5:
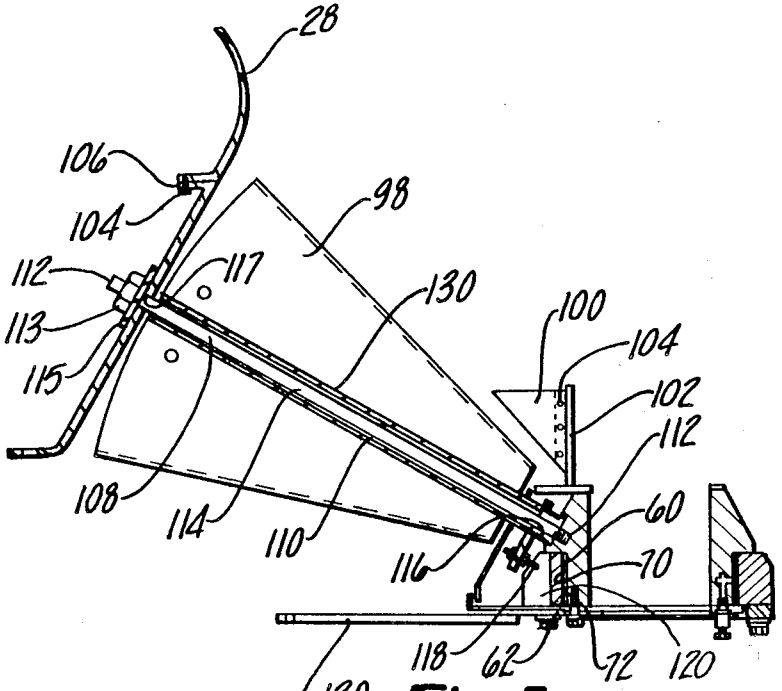
FIG. 5 is a fragmentary side elevational view, partly sectional, of another embodiment of the variable inlet vane assembly and actuation means therefor according to the present invention.

FIG. 5 depicts another embodiment of the variable inlet vane of the present invention. Specifically, Figure 5 depicts a compound main vane blade 98 whose construction will be discussed in reference to FIG. 6. A dorsal vane blade 100 is provided in close proximity to the compound main vane blade in order to control the violent back eddies of air caused by low vane closures. The dorsal vane blade is, as is the case with the other embodiment of this invention, carried upon the carrier assembly 102 and attached thereto by attachment means 104, depicted as nut and bolt assemblies.

The variable inlet vane is comprised of a base ring 106 attached to a conventional venturi 28 by suitable attachment means 104 depicted as bolts. The vane blade pipe 130 is carried within the compound main blade vane and extends the length thereof. Vane pivot shaft 108 extends through pipe 130 the length of the vane blade and has threaded ends 112 at either end which act to retain the vane blades in a pivotally supported relationship relative to the hub and the base ring. Smooth shaft length 114 extends substantially the length of the vane blade and together with bearing means 110, acts to allow the vane blade to pivot along the length of the shaft 108. The shaft extends through aperture 117 in the base ring and as mentioned before, is held in place by retaining means 113, depicted as a nut. If desirable, a washer 115 may be interposed between the nut and the base ring in order to ensure secured relationship between the shaft and the base ring. Its inner hub end shaft is held by the securing means 116 which in the instant case is a socket which mates with the threaded inner end 112 of shaft 108. The securing means 113 maintains the connection between 113 and 112.

At its hub end, the variable inlet vane is equipped with a vane lever linkage means 118 which cooperatively engages the actuating means 120 in a manner to be hereinafter described to effect pivotal movement of the vane as desired. A sliding bearing means 60 is interposed between the actuating means and the hub and is held in place by bearing retaining means 62. The hub forms an inner race 70 for the bearing and the actuating means forms the outer race 72 so that the bearing is held in place relative to these parts and cooperatively engages both of them to increase the ease of operating the actuating means. As with the previous embodiment, the bearing is self lubricating and may be made of any suitable material such as graphite impregnated plastic nylon material.

Figure 6:
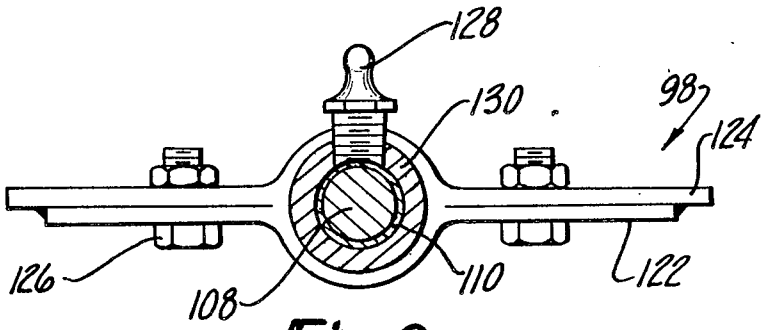
FIG. 6 is an enlarged transverse sectional view of the variable inlet vane of the vane assembly shown in FIG. 5.

FIG. 6 depicts a cross-sectional view of the variable inlet vane assembly of FIG. 5 showing its compound nature. Specifically, compound main vane blade 98 is comprised of an inner vane blade 122 and an outer vane blade 124 held together by securing means 126 depicted as nut and bolt assemblies. Vane blade pipe 130 is held between the inner and outer vane blades such that a channel is formed therein to retain the vane blade pipe. A bearing means 110 is disposed along the inner face of the vane blade pipe and serves to cooperate with pivot shaft 108 to allow the vane blades to pivot about the shaft. An alemite grease fitting 128 may be provided at various places along the length of the vane blade to facilitate lubrication of the bearing means at regular intervals. It should be noted that when the vane blade is in a closed position, all the alemite grease fittings should be orientated to the outside of the assembly such that the operator may easily service and lubricate the vane blades.

Figure 7B:
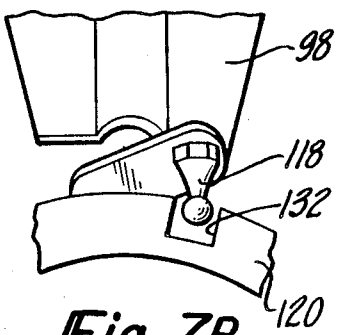
FIGS. 7A and 7B are enlarged, fragmentary partly perspective views of the actuating means and inlet vane shown in FIG. 5.
Figure 7A:
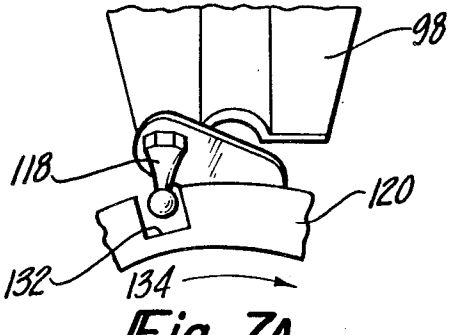

FIGS. 7A and 7B depicts the interaction between the vane lever means of the present invention and the actuating means to effect pivoting of the variable inlet vane of FIG. 5. Specifically, actuating means 120 is equipped at various locations along its circumferential length with recesses 132 which cooperatively engages vane lever means 118. When the actuating means is rotated in the direction indicated by arrow 134, the vane lever means rotates to the position indicated in FIG. 7B. The vane blade is then opened while in this position and by rotating back to the position indicated in FIG. 7A, the vane blade can be closed.

Figure 8:
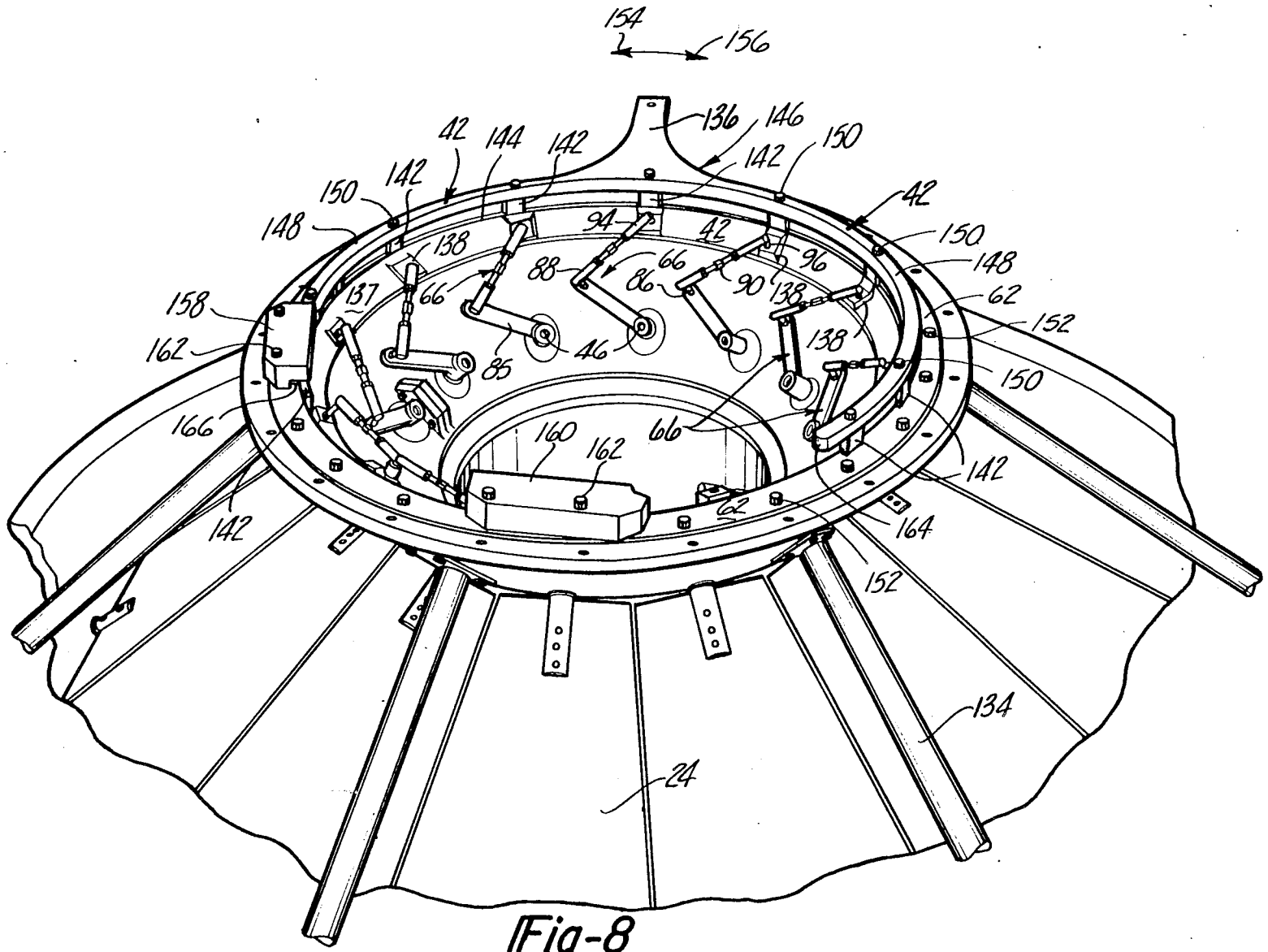
FIG. 8 is a fragmentary prespective view of the variable inlet vane assembly of the present invention depicting the inlet vane actuating means and the orientation of the linkage thereof within the hub.

FIG. 8 depicts a perspective view of the top section of the variable inlet vanes of the present invention depicting linkage means 66 disposed within hub 28. Specifically, this view clearly depicts the hub as a frustroconical structure having the linkage means disposed therein and outside of the flow of air through the vane assemblies. While in this orientation, it can be easily understood that the linkages will not be exposed to incoming air and airborne particulate contaminates thereby greatly reducing the need for routine maintenance checks and, in the event such maintenance is necessary, the orientation of the linkages within the hub makes it easier to repair the linkages because they will not be exposed to the corrosive effects of atmosphere and dirt. As seen in FIG. 8, the actuating means 42 is a ring-shaped structure having an actuating handle or arm 136. The bearing retaining means 62 is another ring-shaped structure and it serves to retain the ring-shaped actuating means in place and to maintain the bearing within the inner and outer races. As is further depicted in FIG. 8, the hub is held in spaced relationship to the base ring by rib supports 134 at various intervals along the circumference of the hub.

As seen in FIGS. 2, 2B, 2C and 8, the actuating means 42 comprises an annular ring-like section 137 which contains the circular race 72 for bearing 60. Upstanding attachment locations in the form of pads 138 are provided integrally of the ring-like section 137 of the actuating means 42 upon the sloping inner surface 140 of the actuating means. The pivots 96 for linkages 66 are mounted on the pads 138.

The actuating means further has a series of upstanding lugs 142 which project above the upper face 144 of the actuating means 42. An operating lever 146, which comprised the arm 136 and a ring-like flange section 148 is secured to the lugs 142 by bolts 150 which are received in tapped mating openings in the lugs.

The actuating means 42 is rotatably secured to hub 22 by bearing retaining means 62. The bearing retaining member 62 is held in position by bolts 152.

The ring-like section 148 is seen to be only a partial section of a full ring. It is approximately 2/3 of a full ring. The actuating member 42 can be rotated upon the bearing 60 by movement of arm 136 and the ring-like flange section 148 in the directions shown (154 and 156). A pair of stops 158 and 160 are secured to hub 22 by bolts 162. The latter extend through retaining means 62 and also contribute to retaining the latter in position.

The arrangement is such that the stops 158 and 160 limit the movement of the actuating means ring-like flange section 148 and thus the actuating means. The stops project over the actuating means 42. The ends 164 of the ring-like flange section 148 will abut the stops when they reach their designated limits of movement. The stops have recesses 166 which are of a size to permit passage of lugs 142 beneath the stops, but the ring-like flange section 148 projects above the lugs 142 which support the flange, an amount such that they will not pass through the recesses. The limit of movement of the vanes can thus be set by position of the stops 158 and 160.

When the actuating means is moved, the linkages are actuated and the vane blades are opened a predetermined amount, depending upon the requirements of the system. When it is desired to vary the amount of air subject to preswirl, the vanes may be moved by means of the actuating means over a wide range.

By way of example, if the assembly is fully open, i.e. the vanes are opened at 10 degrees, there is no preswirl of the incoming air. As the vanes close, the incoming air is preswirled in the direction of the fan, thereby altering its velocity profile and decreasing the work load upon the fan. When the vanes are opened in the opposite direction, for example to −20 degrees, the velocity pressure profile of incoming air is again altered so that a fan may do more work because in terms of air velocity and pressure. In this manner, it is possible to have a smaller fan to drive a given volume of air through a system at a given pressure.

The embodiments of the invention in which an exclusive property or privilege is claimed are defined as follows:

1. A variable inlet vane assembly for use with force draft and induction draft systems having fans mounted upon shafts, said variable inlet vane assembly comprising:

(a) a mounting base;

(b) a hollow frustro-conical hub having an inner and an outer face, said hub of smaller diameter than said mounting base and supported in spaced relationship from said base by a plurality of supports;

(c) a plurality of variable inlet vanes, said vanes pivotally supported by said mounting base and said hub;

(d) said hub and said mounting base defining the throat of the passageway for air passing through said variable inlet vanes with said variable inlet vanes extending longitudinally substantially entirely across said passageway from said mounting base to said hub;

(e) linkage means to pivot said variable inlet vanes, said linkage means carried along the inner face of said hub;

(f) actuating means carried by said hub and connected to said linkage means for actuation of said linkage means, said actuating means comprising a continuous ring-like section received within said hub and supported upon said inner face of said hub;

(g) self-lubricating annular sliding bearing means interposed between said actuating means and said hub;

(h) bearing retaining means functioning to maintain said sliding bearing means in a fixed position; and (i) a plurality of dorsal vanes, said dorsal vanes being downstream and in close relationship to said variable inlet vanes and mounted stationarily thereto to control back eddies of air at low vane closures;

whereby said variable inlet vane assembly is mounted in close proximity to a fan and acts to preswirl incoming air in the direction of rotation of the fan impellers to reduce the work load upon said fan for moving a given volume of air; the sliding bearing means and ring-like actuating means supported upon the inner face of the hub allows for a shorter axial length for the linkge means between the actuating means and the variable inlet vanes, and the hub defines the inner boundary of the air passage thereby allowing for larger inlet vanes for any sized variable inlet vane assembly to present greater control over preswirl of the incoming air, thereby improving the efficiency of the system; and said linkage means is located outside said air flow and is of minimum length and simpler in construction thereby reducing corrosion and maintenance problems due to airborne particulate contaminants and complexity of structure.

2. The variable inlet vane assembly of claim 1 wherein said assembly is connected at said mounting base to a venturi.

3. The variable inlet vane assembly of claim 1 wherein said mounting base is of a hollow frustro-conical configuration.

4. The variable inlet vane assembly of claim 1 wherein said variable inlet vanes are equipped with upper and lower stub shaft means affixed thereto, said mounting base and said hub having a plurality of apertures therethrough to accommodate said stub shafts to pivotally mount said variable inlet vanes within said assembly.

5. The variable inlet vane assembly of claim 4 wherein said apertures within said hub are equipped with bearing means to accommodate said lower stub shaft means for easy pivoting of said main vane blade.

6. The variable inlet vane assembly of claim 5 wherein said upper stub shafts are equipped with a bearing and a cap means to accommodate easy pivoting of said variable inlet vanes.

7. The variable inlet vane assembly of claim 1 wherein said linkage means are separate individual adjustable linkage means each respectively fixedly mounted at one end to one of said lower stub shafts and each pivotally mounted at its other end to a fixed point on said actuating means, whereby movement of said actuating means causes the linkage means to pivot the variable inlet vanes.

8. The variable inlet vane assembly of claim 1 wherein said actuating means is equipped with an actuating arm; whereby the application of force to said actuating arm causes the actuating means to move along said sliding bearing means to cause the linkage means to pivot said variable inlet vanes.

9. The variable inlet vane assembly of claim 1 wherein said sliding bearing means is a graphite impregnated wear-resistant plastic material.

10. The variable inlet vane assembly of claim 1 wherein said sliding bearing means and said hub are equipped with a plurality of apertures and recesses, respectively, said apertures and recesses being aligned; said retaining means being flat-head screws whereby said screws pass through said apertures in said sliding bearing means and into said recesses in said hub to hold the sliding bearing means in place without interfering with the action of the sliding bearing means; said screws being removable to facilitate servicing of said sliding bearing means.

11. The variable inlet vane assembly of claim 1 wherein said variable inlet vanes are compound.

12. The variable inlet vane assembly of claim 11 wherein said variable inlet vanes are comprised of an inner vane blade and an outer vane blade held together by securing means.

13. The variable inlet vane assembly of claim 12 wherein said inner vane blade is smaller than said outer vane blade.

14. A variable inlet vane assembly for use with force draft and induction draft systems having fans, said variable inlet vane assembly comprising:

(a) a mounting base;

(b) a hollow frustro-conical hub having an inner and an outer face, said hub of smaller diameter than said mounting base and supported in spaced relationship thereto by a plurality of supports;

(c) a plurality of compound variable inlet vanes, said compound variable inlet vanes being equipped with a channel means extending the entire length of each said compound variable inlet vane, said compound variable inlet vanes being pivotally supported between said hub and said mounting base;

(d) a pipe means inserted within each said channel means and extending the length of each said compound, variable inlet vane, each said pipe means equipped with bearing means along its interior;

(e) a pivotal shaft extending the length of each said compound variable inlet vane and carried within a said pipe, each said shaft having a smooth shaft portion along substantially its entire length and threaded end portions to accept retaining means, said threaded end portions extending through apertures in said mounting base and said hub;

(f) a lever means to pivot each said compound variable inlet vane, actuating means cooperatively engaging each said lever means for actuation of said lever means, said actuating means comprising a continuous ring-like section received within said hub and supported upon said inner face of said hub;

(g) annular sliding bearing means interposed between said hub and said actuating means;

(h) bearing retaining means functioning to maintain said sliding bearing means in a fixed position for sliding movement of said actuating means along said sliding bearing means; and (i) a plurality of dorsal vanes, said dorsal vanes being downstream and in close relationship to said compound variable inlet vanes and mounted stationarily thereto to control back eddies of air at low vane closures;

whereby said variable inlet vane assembly is mounted in close proximity to a fan and acts to preswirl incoming air in the direction of rotation of the fan impellers to reduce the work load upon said fan for moving a given volume of air; the sliding bearing means allows for a shorter axial length for the linkage means between the actuating means and the compound variable inlet vanes and the hub defines the inner boundary of the air passage thereby allowing for larger inlet vanes for any sized variable inlet vane assembly to present greater control over preswirl of the incoming air thereby improving the efficiency of the system; and said vane lever means is located outside said air flow and is of minimum length and simpler in construction thereby reducing corrosion and maintenance problems due to airborne particulate contamination and complexity of structure.

15. The variable inlet vane assembly of claim 14 wherein said assembly is connected at said mounting base to a venturi.

16. The variable inlet vane assembly of claim 14 wherein said mounting base is of a frustro-conical configuration.

17. The variable inlet vane assembly of claim 14 wherein said compound variable inlet vanes are each comprised of an inner and outer vane blade held together by securing means.

18. The variable inlet vane assembly of claim 14 wherein each said channel is equipped with alemite grease fittings to allow lubrication of said bearing means within said pipe means.

19. The variable inlet vane assembly of claim 14 wherein each said shaft is held stationary between said hub and said mounting base and a said lever means is attached to each said compound variable inlet vane whereby actuating said lever means causes the compound variable inlet vane blade to pivot about its respective said shaft.

20. The variable inlet vane assembly of claim 14 wherein said sliding bearing means is a graphite impregnated wear-resistant plastic material.

21. The variable inlet vane assembly of claim 14 wherein said sliding bearing means is secured to said hub by retaining means whereby said sliding bearing may be held securely in place during operation of the assembly and easily removed for servicing or replacement.

22. The variable inlet vane assembly of claim 21 wherein said sliding bearing means is retained in place by flat-head screws.

23. The variable inlet vane assembly of claim 14 wherein said actuating means is ring-shaped and equipped with an actuating arm, said actuating means further provided with a plurality of locations spaced circumferentially along its length cooperatively engaging said lever means to pivot said compound variable inlet vanes when force is applied to said actuating arm.

* * * * *

UNITED STATES PATENT AND TRADEMARK OFFICE

CERTIFICATE OF CORRECTION

PATENT NO. : 4,681,509

DATED : July 21, 1987

INVENTOR(S) : ROBERT J. DAVIS

It is certified that error appears in the above-identified patent and that said Letters Patent is hereby corrected as shown below:

Column 4, line 4 "air" should read --aid--.

Column 10, claim 18, line 50, "alemite" should be deleted and --a-- inserted.

Signed and Sealed this

Nineteenth Day of January, 1988

*Attest:*

DONALD J. QUIGG

*Attesting Officer*

*Commissioner of Patents and Trademarks*